US009565492B2

(12) United States Patent
Ring

(10) Patent No.: US 9,565,492 B2
(45) **Date of Patent: *Feb. 7, 2017**

(54) ACTIVE NOISE REDUCTION HEADPHONE

(71) Applicant: Bose Corporation, Framingham, MA (US)

(72) Inventor: Martin Ring, Ashland, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/232,352

(22) Filed: Aug. 9, 2016

(65) Prior Publication Data

US 2016/0353197 A1 Dec. 1, 2016

Related U.S. Application Data

(63) Continuation of application No. 14/095,507, filed on Dec. 3, 2013, now Pat. No. 9,445,184.

(51) Int. Cl.
*H04R 1/10* (2006.01)
*G10K 11/178* (2006.01)

(52) U.S. Cl.
CPC ..... *H04R 1/1083* (2013.01); *G10K 11/1784* (2013.01); *G10K 2210/1081* (2013.01)

(58) Field of Classification Search
CPC ..... H04R 1/1083
(Continued)

(56) References Cited

U.S. PATENT DOCUMENTS 5,046,103 A * 9/1991 Warnaka ..... G10K 11/1784 381/71.5
8,447,045 B1 5/2013 Laroche
(Continued)

FOREIGN PATENT DOCUMENTS

EP 1768109 A1 3/2007
GB 2149614 A 6/1985
(Continued)

OTHER PUBLICATIONS

International Search Report and Written Opinion in related International Patent Application No. PCT/US14/67406, mailed on Apr. 29, 2015; 16 pages.
(Continued)

*Primary Examiner* — Md S Elahee

(74) *Attorney, Agent, or Firm* — Schmeiser, Olsen & Watts LLP; William G. Guerin

(57) ABSTRACT

An active noise reduction earphone includes a speaker, a plurality of microphones and a feedback system. Each microphone is displaced from the speaker and the other microphones, and each microphone generates a microphone signal responsive to received acoustic noise. The feedback system receives a combination of the microphone signals and generates an inverse noise signal that is applied to the speaker. The speaker generates an inverse acoustic noise signal that substantially cancels the acoustic noise signal at a predetermined location relative to the speaker and the microphones. The feedback system can include a microphone signal combiner in communication with the microphones. The microphone signal combiner generates a signal that may be a sum or weighted sum of the microphone signals and can be used to generate the inverse noise signal. The earphone has an increased noise reduction bandwidth and improved cancellation capability relative to conventional earphones.

20 Claims, 7 Drawing Sheets

(58) Field of Classification Search
USPC ..... 381/71.1, 71.5, 71.6, 93
See application file for complete search history.

(56) References Cited

U.S. PATENT DOCUMENTS

| | | | |
|---|---|---|---|
| 8,903,101 | B2 | 12/2014 | Christoph et al. |
| 2005/0249355 | A1 | 11/2005 | Chen et al. |
| 2006/0153394 | A1 | 7/2006 | Beasley |
| 2009/0016542 | A1 | 1/2009 | Goldstein et al. |
| 2010/0131269 | A1 | 5/2010 | Park et al. |
| 2013/0129106 | A1 | 5/2013 | Sapiejewski |

FOREIGN PATENT DOCUMENTS

| | | | |
|---|---|---|---|
| WO | 8101480 | A1 | 5/1981 |
| WO | 9205538 | A1 | 4/1992 |

OTHER PUBLICATIONS

International Preliminary Report on Patentability in counterpart International Patent Application No. PCT/US14/67406, mailed on Jun. 16, 2016; 11 pages.
Non-Final Office Action issued in related U.S. Appl. No. 14/095,507, mailed on Jun. 30, 2015; 15 pages.
Non-Final Office Action issued in related U.S. Appl. No. 14/095,507, mailed on Nov. 30, 2015; 15 pages.
Notice of Allowance and Fees Due issued in related U.S. Appl. No. 14/095,507, mailed on Jul. 15, 2016; 8 pages.

* cited by examiner

ACTIVE NOISE REDUCTION HEADPHONE

RELATED APPLICATION

This application is a continuation application of U.S. application Ser. No. 14/095,507, filed Dec. 3, 2013 and titled "Active Noise Reduction Headphone," the entirety of which application is incorporated by reference herein.

BACKGROUND

This disclosure relates to active noise reduction and more specifically to headphones that use multiple feedback microphones for active noise reduction.

SUMMARY

All examples and features mentioned below can be combined in any technically possible way.

In one aspect, a method for active noise reduction includes generating a first electrical signal responsive to an acoustic noise signal at a first location in an acoustic cavity. A second electrical signal responsive to the acoustic noise signal at a second location in the acoustic cavity is generated. The first and second locations are fixed in position relative to each other and relative to a speaker disposed in the acoustic cavity. The first and second electrical signals are combined to form a single feedback error signal. A speaker input signal is generated in response to the single feedback error signal. The speaker input signal includes an inverse noise signal to generate an inverse acoustic noise signal at the speaker that reduces the acoustic noise signal at a predetermined location relative to the speaker and the first and second locations.

Examples may include one or more of the following features:

The first location may be proximate to the speaker.

The method may further include generating at least one additional electrical signal responsive to an acoustic noise signal at a location that is separate from the speaker and from the first location, the second location and any other location for which any other additional signal is generated. The combined signal may include a combination of the first electrical signal, the second electrical signal and the at least one additional electrical signals.

The acoustic cavity may include an ear canal.

The combining of the first and second electrical signals may include summing the first and second electrical signals. A weight may be applied to at least one of the first and second electrical signals prior to summing the first and second electrical signals. The first and second electrical signals may be digital signals and the summing of the first and second electrical signals may include a digital addition of the digital signals. The first and second electrical signals may be current signals and the summing of the first and second electrical signals may include summing the current signals. The first and second electrical signals may be voltage signals and the summing of the first and second electrical signals may include summing the voltage signals. Each voltage signal may be a voltage across a resistive load in in a serial configuration of a plurality of resistive loads.

The speaker input signal may further include an audio signal.

In accordance with another aspect, a method for active noise reduction includes generating a plurality of electrical signals each responsive to an acoustic noise signal at a different location in an acoustic cavity and combining the plurality of electrical signals to form a single feedback error signal. The method further includes generating a speaker input signal in response to the single feedback error signal. The speaker input signal includes an inverse noise signal to generate an inverse acoustic noise signal at the speaker that reduces the acoustic noise signal at a predetermined location relative to the speaker and the different locations in the acoustic cavity.

Examples may include one or more of the following features:

The acoustic cavity may include an ear canal.

The combining of the plurality of electrical signals may include summing the plurality of electrical signals. A weight may be applied to at least one of the electrical signals prior to summing the plurality of electrical signals. The plurality of electrical signals may be digital signals and the summing of the plurality of electrical signals may include a digital addition of the digital signals. The electrical signals may be current signals and the summing of the plurality of electrical signals may include summing the current signals. The electrical signals may be voltage signals and the summing of the plurality of electrical signals may include summing the voltage signals. Each voltage signal may be a voltage across a resistive load in a serial configuration of a plurality of resistive loads.

The speaker input signal may further include an audio signal.

DETAILED DESCRIPTION

Figure 1:
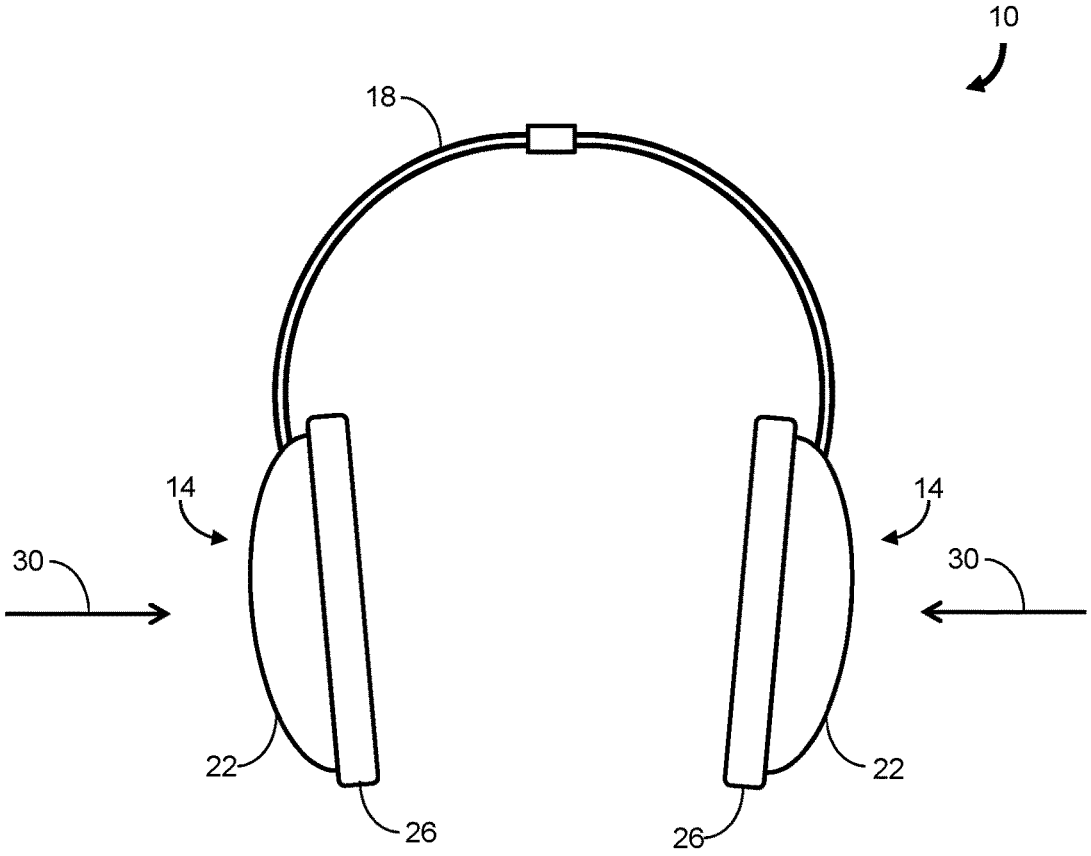
FIG. 1 is an illustration of an embodiment of an active noise reduction headphone.

Active noise reduction (ANR) headphones and other physical configurations of personal ANR devices with earphones worn about the ears of a user for purposes of isolating the user's ears from unwanted environmental sounds have become commonplace. ANR headphones in which unwanted environmental noise sounds are countered with the active generation of anti-noise sounds have become prevalent, even in comparison to headphones or ear plugs employing only passive noise reduction technology, in which a user's ears are simply physically isolated from environmental noise sounds.

ANR headphones may use feedback or feed-forward control systems, or a combination of the two. Feedback based ANR headphones typically utilize a feedback system that includes a microphone positioned at a location that is near the ear of a user and also near the earphone speaker. A feedback circuit attempts to reduce the energy in the microphone signal generated as a result of the acoustic noise to zero. To cancel the noise signal sensed by the microphone, a compensating signal is generated that is 180° out of phase with the sensed noise signal. Due to the distance between the speaker and the microphone, the phase difference between the noise signal at the speaker and the noise signal received at the microphone increases with increasing frequency. Thus the higher frequencies may be subject to a significant phase difference based on the separation of the microphone and the speaker, resulting in a bandwidth limitation on the feedback system. Lower frequencies are more readily canceled while increasingly higher frequencies become more difficult to cancel until, above some frequency, cancellation is not possible.

The acoustic signals can vary according to location in an earphone, therefore it is typically desirable to provide the microphone at a location near the ear to more accurately determine the noise received at the ear. However, the phase difference at a given frequency increases according to the increased distance from the speaker, thus any benefit from locating the microphone near the ear is at least partially negated. The location of the microphone in the headphone is generally selected to balance these two competing effects, and this location typically differs according to the variations in dimensions for different types of earphones. Moreover, the frequency range for which ANR can be effectively implemented generally varies between different types of earphones.

The present teaching will now be described in more detail with reference to various embodiments thereof as shown in the accompanying drawings. Reference in the specification to "one embodiment" or "an embodiment" means that a particular feature, structure or characteristic described in connection with the embodiment is included in at least one embodiment of the teaching. References to a particular embodiment within the specification do not necessarily all refer to the same embodiment. While the present teaching is described in conjunction with various embodiments and examples, it is not intended that the present teaching be limited to such embodiments. On the contrary, the present teaching encompasses various alternatives, modifications and equivalents, as will be appreciated by those of skill in the art. Those of ordinary skill having access to the teaching herein will recognize additional implementations, modifications and embodiments, as well as other fields of use, which are within the scope of the present disclosure as described herein.

In brief overview, the invention relates to a method and to an active noise reduction earphone that includes an earphone body, a speaker, a plurality of microphones and a feedback system. Each of the microphones is displaced from the speaker and the other microphones, and generates a microphone signal responsive to received acoustic noise. The feedback system receives a combination of the microphone signals and generates an inverse noise signal that is applied to the speaker. The speaker generates an inverse acoustic noise signal that substantially cancels the acoustic noise signal at a predetermined location relative to the speaker and the microphones.

Advantageously, the method and earphone allow for improved performance, for example, by increasing the noise reduction bandwidth, and can generally improve the cancellation capability when compared to conventional earphones based on a noise cancellation feedback system employing a single microphone.

FIG. 1 shows an active noise reduction headphone 10 that includes two earphones 14 connected by a headband 18. As illustrated, each earphone 14 includes an earphone body having a cup-shaped shell 22 and a cushion 26. The headband 18 exerts a force in an inward direction as represented by arrows 30 so that the cushion 26 is urged against the head of a user and surrounding the ear (typically referred to as circumaural) to enclose an acoustic cavity which may include the outer ear and ear canal. In alternative configurations, the earphone body may have a different form and may be urged against the ear of the user (typically referred to as supra-aural) to enclose an acoustic cavity, which may include the outer ear and ear canal, or urged into the ear canal (typically referred to as intra-aural) to define an acoustic cavity which may include the ear canal. Intra-aural headphones may be implemented without the headband 18 by inserting a portion of the earphone into the ear canal.

Figure 2:
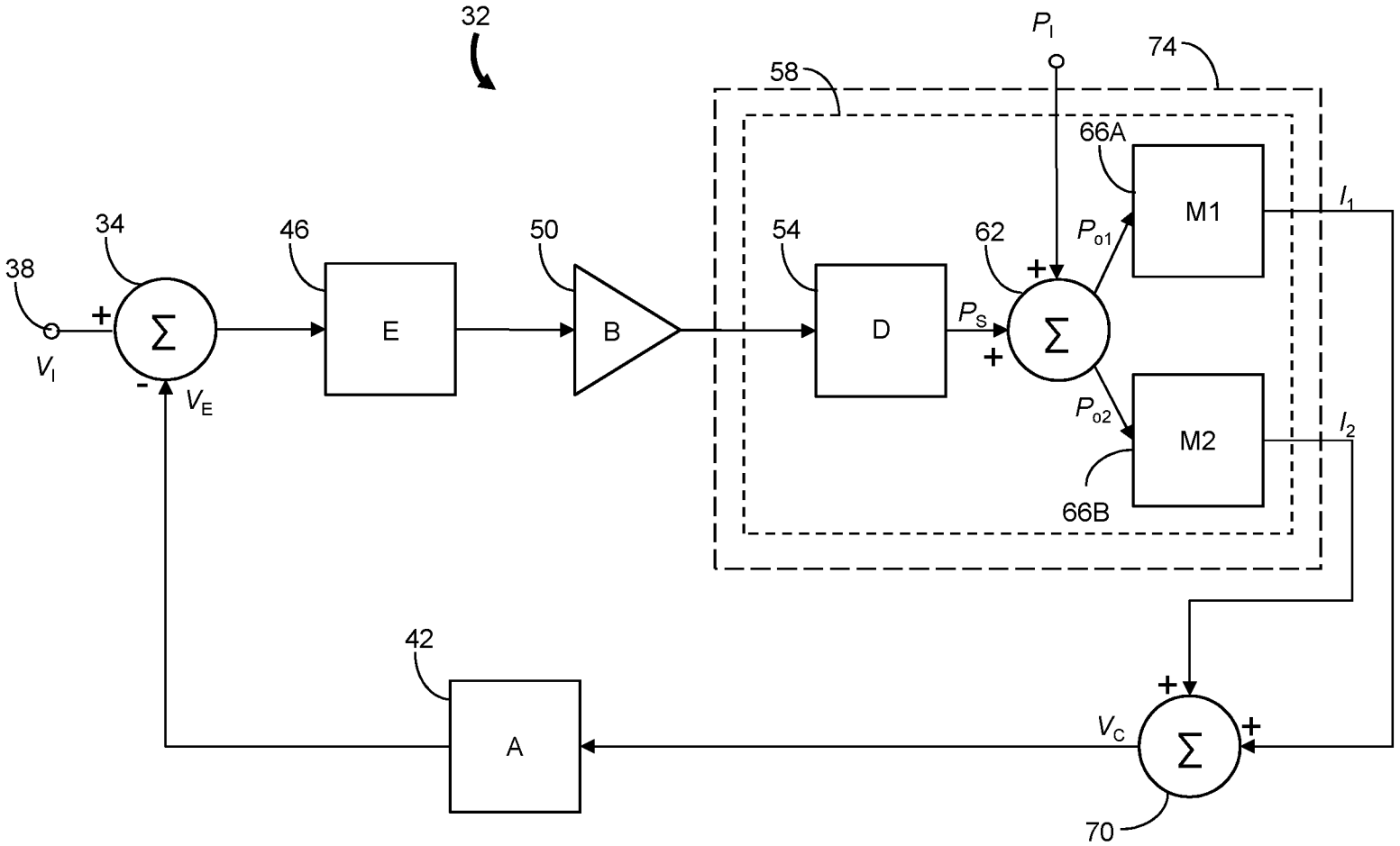
FIG. 2 is a block diagram of a logical arrangement of a feedback loop for use in the earphones of the headphone of FIG. 1.

Referring to FIG. 2, a block diagram illustrates the logical arrangement of a feedback loop 32 in an embodiment of an ANR headphone. A signal combiner 34 is coupled to a terminal 38 to receive an optional input audio signal $V_I$ and is in communication with a feedback preamplifier 42 and a compensator 46 which is in turn coupled to a power amplifier 50. The power amplifier 50 is in communication with an acoustic driver (i.e., speaker) 54 in a cavity represented by dotted line 58. The cavity 58 is formed when one of the earphones of the ANR headphone is pressed into, against or around a user's ear.

A combiner 62 present within the cavity 58 is not a physical element but instead functionally represents the summation of acoustic noise $P_I$ entering the cavity 58 from the external environment and the acoustic energy $P_S$ radiated into the cavity 58 from the speaker 54. The summation results in acoustic energy $P_O$ within the cavity 58, represented as $P_{O1}$ for the acoustic energy received at a first microphone 66A and $P_{O2}$ for the acoustic energy received at a second microphone 66B. The acoustic energy received at the two microphones 66 is different because the microphones 66 are at different locations inside the earphone. More specifically, the acoustic energy from the speaker 54 that is received at each microphone 66 is different and the external acoustic noise energy received at each microphone 66 is different. The microphones 66 are in communication with a microphone signal combiner 70. By way of example, if the microphones 66 provide a current having a magnitude that is responsive to the amplitude of the received acoustic energy, the microphone signal combiner 70 may be a resistance load that is common to the outputs of both microphones 66. Thus the current through the resistive load is the sum of the currents from the two microphones 66. In another example, if each microphone 66 generates an output voltage that is responsive to the amplitude of the received acoustic energy, the microphone signal combiner 70 may be a serial configuration of separate resistive loads. In yet another example, if the microphones 66 output digital signals numerically representing the amplitude of the received acoustic energy, the microphone signal combiner 70 may be a digital adder, and may be implemented within a DSP or other microprocessor. In some embodiments, the DPS or microprocessor may not simply perform a summing function but instead may process the microphone signals according to one or more algorithms that may include frequency-dependent processing. The acoustic elements of FIG. 2, including the speaker 54, the two microphones 66 and the cavity 58, are referred to as the "acoustic block" 74. Any or all of the electronic elements (i.e., 34, 42, 46, 50, and 70) in FIG. 2 may be implemented in analog or digital circuitry, including digital signal processors, with appropriate analog-to-digital and digital-to-analog converters added where necessary.

Figure 3A:
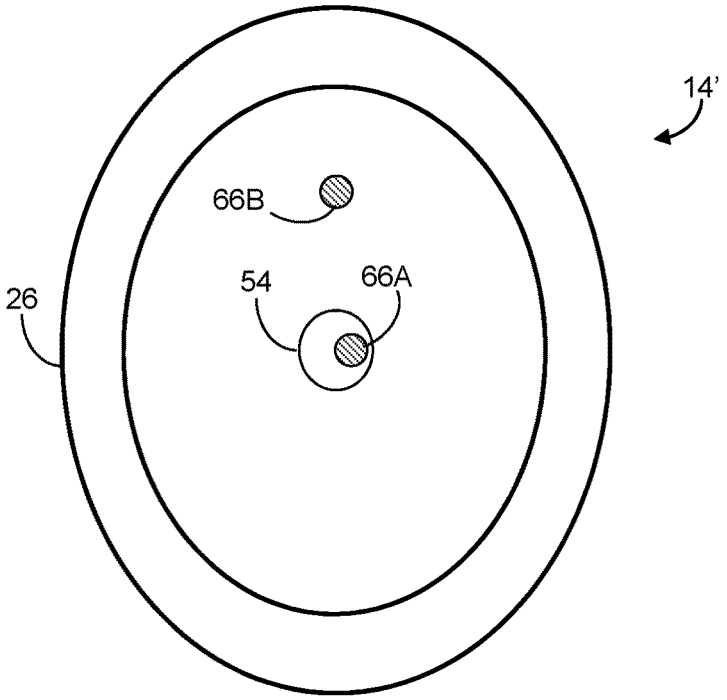
FIG. 3A and FIG. 3B are an internal view and a cross-sectional side view, respectively, of an earphone for an active noise reduction headphone.
Figure 3B:
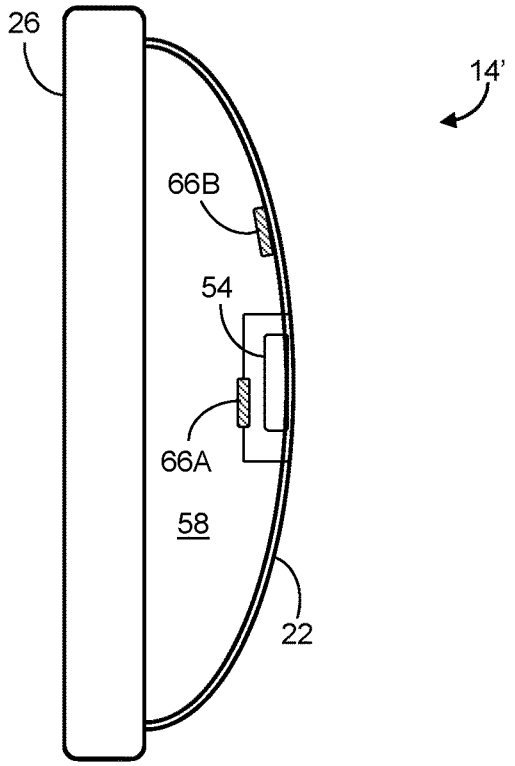

Reference is now made to FIG. 3A and FIG. 3B which show an end view and a cross-sectional side view, respectively, of an earphone 14'. One of the microphones 66A is located close to the coil of speaker 54, for example, it may be mounted on some mechanical feature in front of the speaker, between the speaker 54 and the ear. The other microphone 66B is located at a greater distance from the speaker 54, for example, off to the side near the inner surface of shell 22. In some embodiments the second microphone 66B is remotely located such that it is closer to the ear when the headphone is worn by a user, although this is not a requirement.

Referring again to FIG. 2, in operation, an amplified error signal $V_E$ is combined subtractively with an input audio signal $V_I$ at signal combiner 34 which in turn provides the differentially summed signals to the compensator 46. If no input audio signal is present, the inverted error signal $-V_E$ is simply provided to the compensator 46. The compensator 46 provides phase and gain margin to meet the Nyquist stability criterion. Increasing the phase margin can extend the bandwidth over which the system remains stable, can increase the magnitude of feedback applied over a frequency range to increase active noise reduction, or both. Compensation, which includes applying a pattern in which the magnitude varies with frequency, is similar to the process called "equalization" and for the purposes of this specification an equalization that is applied within feedback loop 32 is equivalent to compensation. There may be other equalizations in the loop 32; for example audio signal $V_I$ may be equalized prior to being applied to signal combiner 34. Power amplifier 50 amplifies the compensated signal and provides the amplified signal to the speaker 54. The speaker 54 transduces the amplified signal to acoustic energy, which combines with noise $P_I$ entering the cavity 58 to form combined acoustic energy $P_O$. Each microphone 66A and 66B transduces received acoustic energy $P_{O1}$ and $P_{O2}$, respectively, to a corresponding microphone signal $I_1$ and $I_2$, respectively. The two microphone signals $I_1$ and $I_2$ are summed or otherwise combined at the microphone signal combiner 70, for example, into a voltage I/O representing the combined microphone signals. The combined signal $V_C$ is amplified by preamplifier 42 and presented subtractively as an error signal $V_E$ to the signal combiner 34.

The closed loop transfer function of the circuit of FIG. 2 is $$\frac{P_O}{V_I} = \frac{EBD}{1 + EBDMA}$$

where E, B, D, M and A represent the frequency dependent transfer functions of the compensator 46, the power amplifier 50, the speaker 54, the microphone network (microphones 66A and 66B, and microphone signal combiner 70) and the feedback preamplifier 42, respectively. If the EBDMA term of the denominator is −1 (i.e., the equivalent of |EBDMA| equal to one and a phase angle of −180°), the circuit is unstable. It is therefore desirable to arrange the circuit so that the there is a phase margin (as described below) so that the phase angle of EBDMA does not approach −180° for any frequency at which |EBDMA| is greater than or equal to one. For example, if the circuit is arranged so that at any frequency at which |EBDMA| is greater than or equal to one, the phase angle is not more negative than −135°, the phase margin is at least 45° (i.e. 180°-135°). Stated differently, to maintain a typical desirable phase margin of no less than 45°, the phase angle of EBDMA at the crossover frequency (the frequency at which the gain of EBDMA is unity or 0 dB) should be less than or equal to −135°. Causing the phase of transfer function EBDMA to be less negative in the vicinity of the crossover frequency can allow an increase in the crossover frequency, thereby extending the effective bandwidth of the system.

Changes of phase angle as a function of frequency are a result of at least two causes: time delays and phase shifts associated with the magnitude of the transfer functions E, B, D, M and A, which may be frequency dependent. Time delays (e.g., the time delays between the radiation of acoustic energy by the speaker 54 and the arrival of the acoustic energy at each of the microphones 66A and 66B) act as a phase shift that is linear as a function of frequency. Other examples of time delays are delays in signal processing components. Phase shifts associated with transfer functions E, B, D, M and A are typically variable with respect to frequency. It is desirable to reduce time delays and to reduce or compensate for phase shifts associated with transfer function EBDMA so that the phase angle of the circuit does not approach −180° and preferably does not exceed −135° for frequencies at which the magnitude of EBDMA exceeds unity (i.e., 0 dB).

In contrast to a conventional earphone in which a single microphone is employed in a feedback loop to reduce or eliminate external acoustic noise, embodiments of the earphone (such as those according to FIG. 2 and FIGS. 3A and 3B) where two or more microphones are placed within the cavity can better manage acoustic variations within the cavity and accommodate the acoustic field at a user's ear. The particular types of microphones and the location of the microphones with respect to each other and the earphone body are selected to achieve a desired level of performance according, at least in part, to the geometry of the earphone and the resulting acoustic cavity. A microphone located near the speaker has a small time delay. In contrast, a microphone at a greater distance from the speaker will have a greater time delay; however, the proximity to the ear allows the microphone to more accurately sample the acoustic energy received at the ear. Moreover, the use of two or more microphones can result in improved performance for the earphone.

Figure 4:
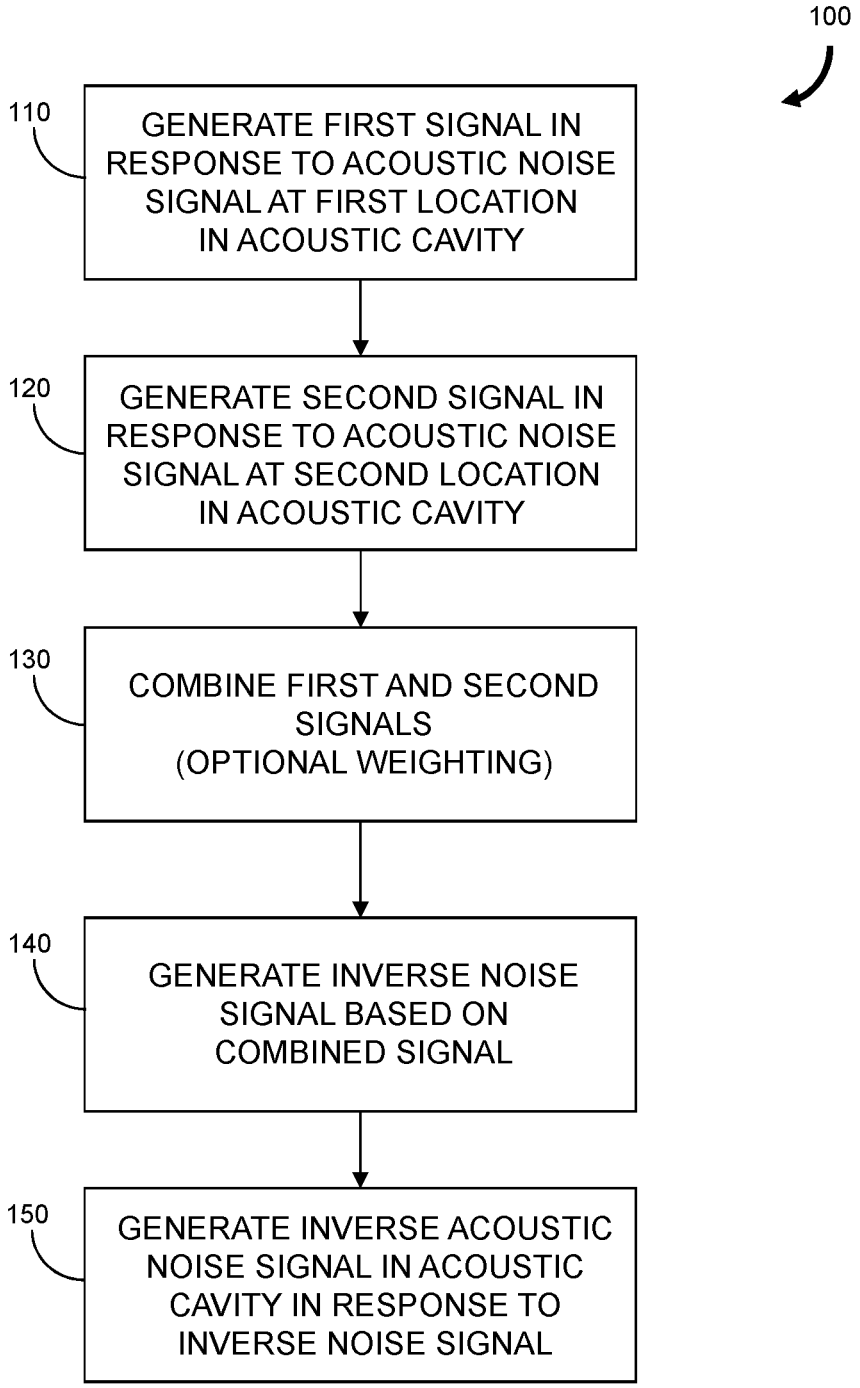
FIG. 4 is a flowchart representation of an embodiment of a method for active noise reduction for an earphone.

FIG. 4 is a flowchart representation of an embodiment of a method 100 for active noise reduction. The method includes generating (110) a first signal that responds to an acoustic noise signal at a first location in an acoustic cavity and generating (120) a second signal that responds to the acoustic noise signal at a second location in the acoustic cavity. The first and second locations are preferably separate from each other and from an acoustic speaker within the cavity. The first and second signals are combined (130), for example, by summing a current or a voltage corresponding to the first and second signals. In an optional further embodiment, different weights and/or processes are applied to the first and second signals as part of the combination process, for example, by providing differing gains, attenuations or filters. An inverse noise signal is generated (140) in response to the combined signals. An inverse acoustic noise signal is generated (150) in the acoustic cavity in response to the inverse noise signal. The inverse acoustic noise signal substantially cancels the acoustic noise signal at a predetermined location in the acoustic cavity. The predetermined location may be the location of a user's ear canal.

In further embodiments of the method 100, one or more additional signals that are responsive to the acoustic noise signal at additional locations within the acoustic cavity are used. In such embodiments, the combined signal includes a combination of the first signal, the second signal and the one or more additional signals.

Figure 5:
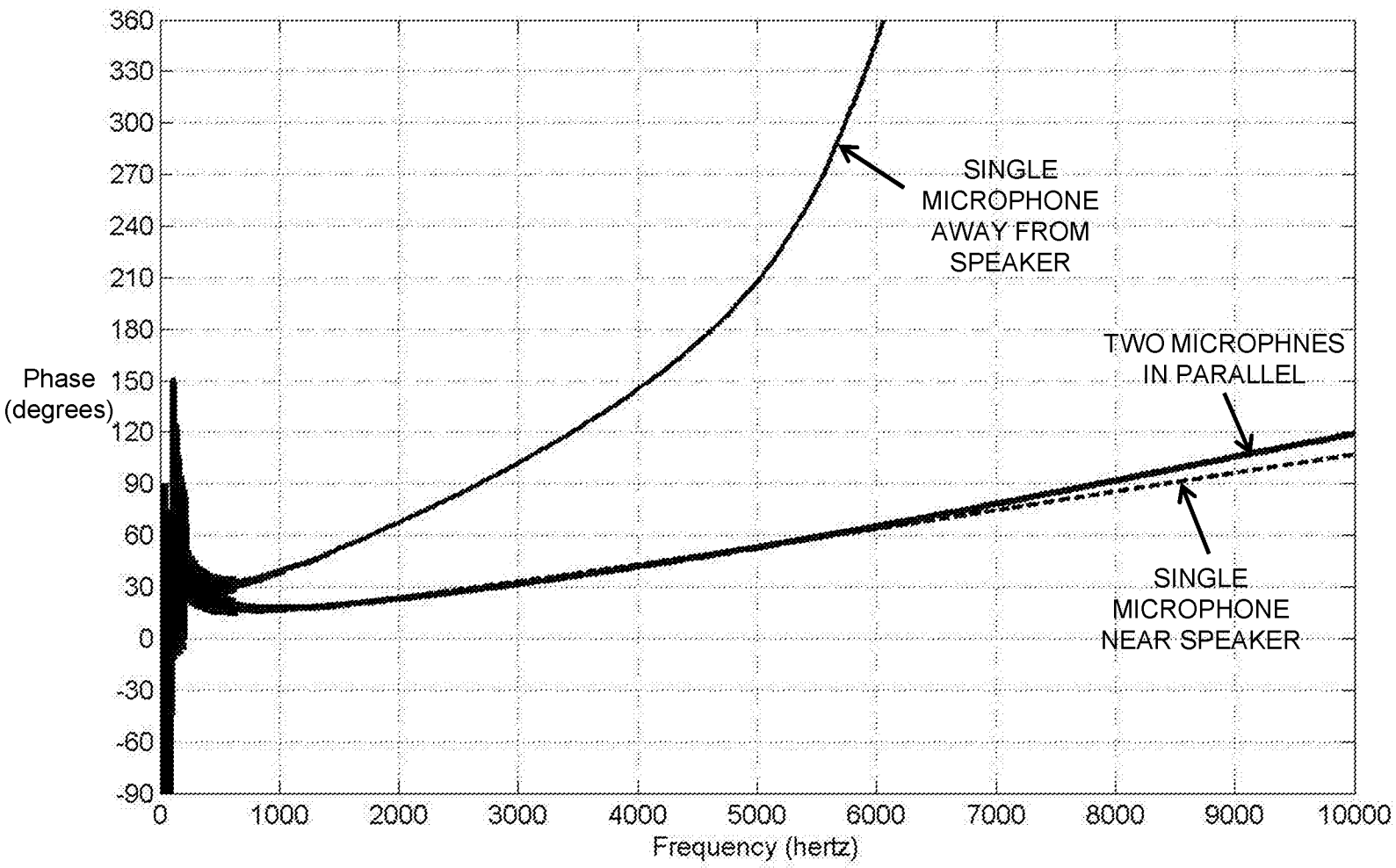
FIG. 5 is a plot of measured non-minimum phase as a function of frequency for three different microphone configuration arrangements for an earphone.

FIG. 5 illustrates the measured non-minimum phase of three signals as a function of frequency. The signal with the least measured non-minimum phase and the signal with the greatest measured non-minimum phase correspond to the signal from the single microphone 66A near the speaker 54 and the single microphone 66B furthest from the speaker 54, respectively (see FIG. 3A and FIG. 3B). The signals were measured using microphones 66 having the same sensitivity. The measured non-minimum phase for microphone 66A is nearly linear across the measured frequencies because the non-minimum phase variation is due primarily to time delay. The combination of the signals from both microphones 66 using a parallel load coupling configuration yields a non-minimum phase that is nearly identical to the non-minimum phase for the signal from the single microphone 66A closest to the speaker 54 at lower frequencies and is only slightly greater at the higher frequencies. Thus the utilization of a second microphone does not result in a substantial degradation to the non-minimum phase $$\left(\text{TIME DELAY} = \left(\frac{1}{\text{FREQUENCY}}\right)\left(\frac{\text{NON} - \text{MINIMUM PHASE}}{360^\circ}\right)\right).$$

Figure 6:
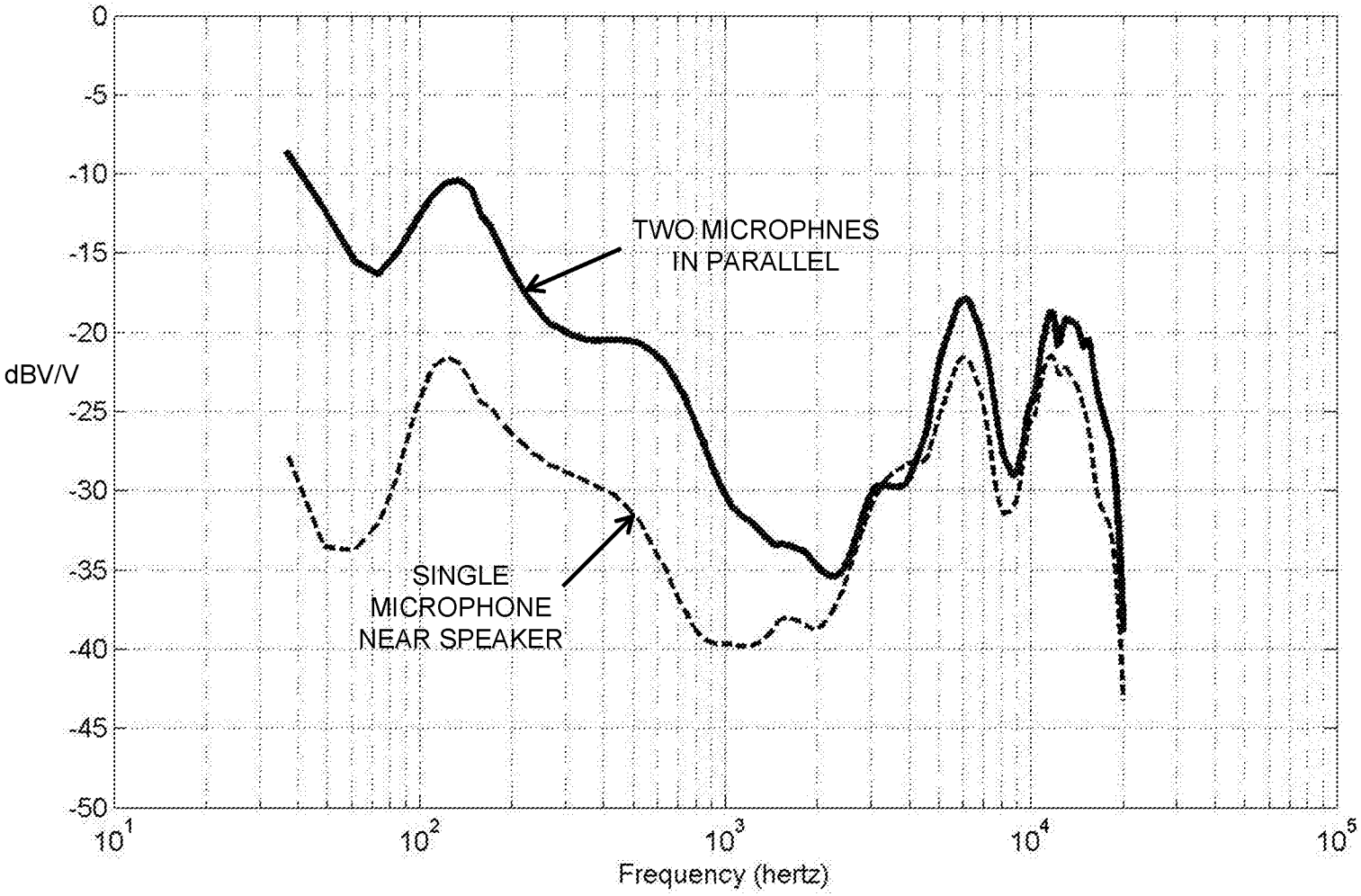
FIG. 6 is a plot of the measured transfer function for a single microphone configuration in an earphone and an embodiment in which two microphones are provided in an earphone.

FIG. 6 illustrates the transfer functions of the two configurations. More specifically, the figure shows (1) the output voltage of the single microphone 66A relative to the input voltage of the speaker 54 and (2) the output voltage of the combined signals of the two microphones 66A and 66B relative to the input voltage of the speaker 54. The parallel microphone configuration exhibits higher signal at frequencies below about 2 KHz.

Figure 7:
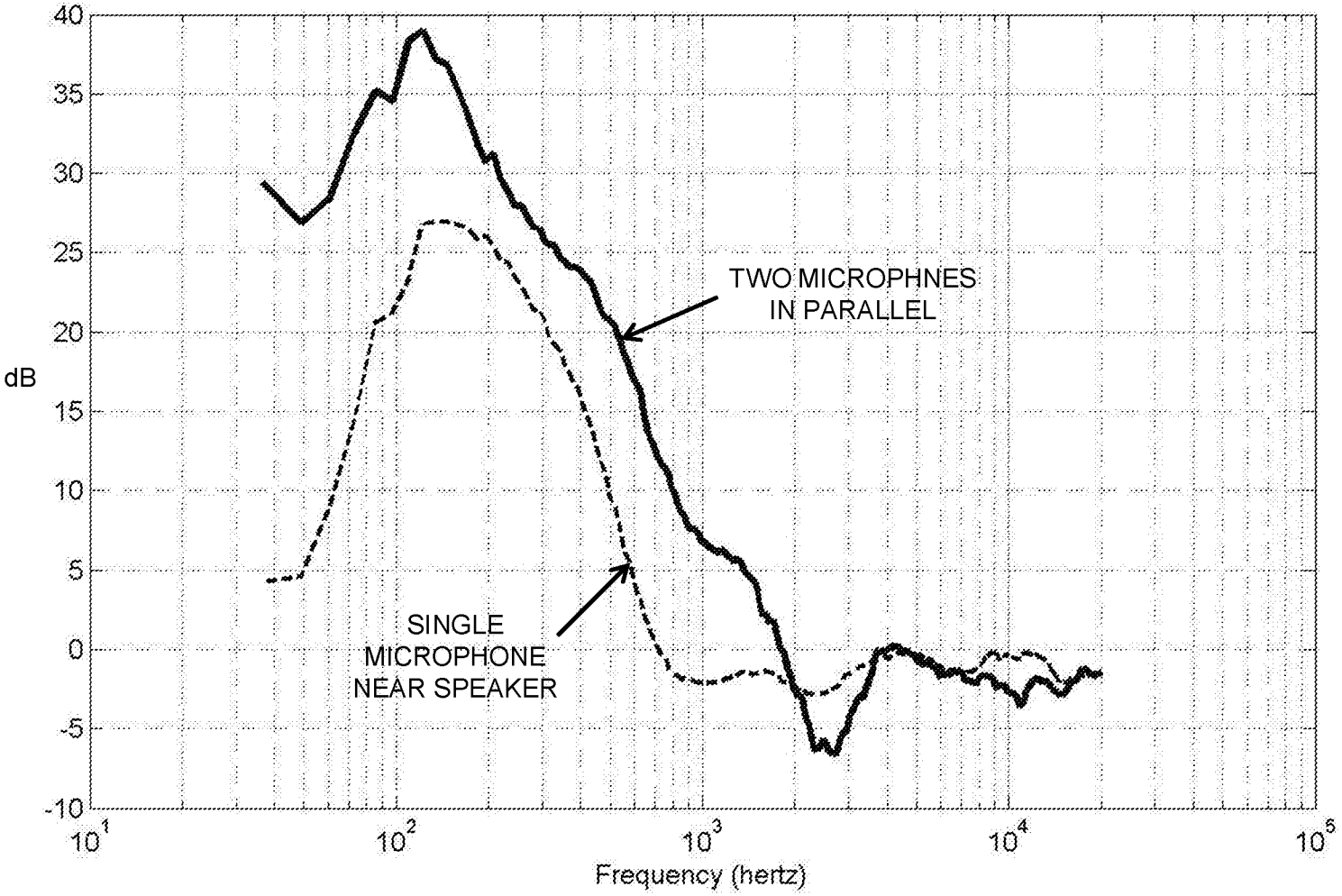
FIG. 7 is a plot of the cancellation that can be achieved as a function of frequency for an earphone having a single microphone and for an embodiment of an earphone having a dual microphone configuration.

FIG. 7 illustrates noise cancellation that can be achieved as a function of frequency.

At frequencies below approximately 2 KHz, the two microphone configuration yields a substantial performance improvement over a feedback system employing only the single microphone 66A closest to the speaker 54. For example, there is an approximately 15 dB improvement at 700 Hz and an approximately 9 dB improvement at 1 KHz. For frequencies above approximately 2 KHz, the performance for the two configurations is approximately the same; however, at these higher frequencies, noise cancellation requirements are generally substantially reduced, especially in earphones having high passive noise reduction performance. The substantial performance improvement of the two microphone configuration results in an increased effective ANR bandwidth. For example, the 0 dB maximum cancellation for the two microphone configuration occurs at approximately 2 KHz versus at approximately 700 Hz for the single microphone 66A near the speaker 54.

Thus the benefit of the two microphone configuration is the improved bandwidth and performance of the ANR system at lower frequencies without significant impact on delay. It should be noted that if the single microphone 66B near the ear were used instead of the single microphone 66A near the speaker, one could achieve a similar improvement in performance; however the phase delay would be significantly adversely affected and the bandwidth would be narrower.

In other embodiments, three or more microphones may be used and advantages similar to embodiments utilizing two microphones are realized. The increased number of microphones provides the capability to sample the acoustic energy at additional locations that can provide benefits when standing modes are present. The microphone signals may be combined equally. Alternatively, the microphone signals may be weighted differently to achieve a desired cancellation performance, or even processed individually using a different method. In other words, N microphones may be processed using M methods that result in a single feedback error signal $V_E$.

A number of implementations have been described. Nevertheless, it will be understood that additional modifications may be made without departing from the scope of the inventive concepts described herein, and, accordingly, other embodiments are within the scope of the following claims.

What is claimed is:

1. A method for active noise reduction, the method comprising:

generating a first electrical signal at a first feedback microphone responsive to an acoustic noise signal at a first location in an acoustic cavity;

generating a second electrical signal at a second feedback microphone responsive to the acoustic noise signal at a second location in the acoustic cavity, the first and second locations being fixed in position relative to each other and relative to a speaker disposed in the acoustic cavity;

combining the first and second electrical signals to form a single feedback error signal; and generating a speaker input signal in response to the single feedback error signal, wherein the speaker input signal comprises an inverse noise signal to generate an inverse acoustic noise signal at the speaker that reduces the acoustic noise signal at a predetermined location relative to the speaker and the first and second locations.

2. The method of claim 1 wherein the first location is proximate to the speaker.

3. The method of claim 1 further comprising generating at least one additional electrical signal at an additional feedback microphone responsive to an acoustic noise signal at a location that is separate from the speaker and from the first location, the second location and any other location for which any other additional signal is generated, wherein the combined signal comprises a combination of the first electrical signal, the second electrical signal and the at least one additional electrical signals.

4. The method of claim 1 wherein the acoustic cavity comprises an ear canal.

5. The method of claim 1 wherein combining the first and second electrical signals comprises summing the first and second electrical signals.

6. The method of claim 5 further comprising applying a weight to at least one of the first and second electrical signals prior to summing the first and second electrical signals.

7. The method of claim 1 wherein the speaker input signal further comprises an audio signal.

8. The method of claim 5 wherein the first and second electrical signals are current signals and wherein the summing of the first and second electrical signals comprises summing the current signals.

9. The method of claim 5 wherein the first and second electrical signals are voltage signals and wherein the summing of the first and second electrical signals comprises summing the voltage signals.

10. The method of claim 9 wherein each voltage signal comprises a voltage across a resistive load in a serial configuration of a plurality of resistive loads.

11. The method of claim 5 wherein the first and second electrical signals are digital signals and wherein the summing of the first and second electrical signals comprises a digital addition of the digital signals.

12. A method for active noise reduction, the method comprising:

generating a plurality of electrical signals each at a feedback microphone that is responsive to an acoustic noise signal at a different location in an acoustic cavity;

combining the plurality of electrical signals to form a single feedback error signal; and generating a speaker input signal in response to the single feedback error signal, wherein the speaker input signal comprises an inverse noise signal to generate an inverse acoustic noise signal at the speaker that reduces the acoustic noise signal at a predetermined location relative to the speaker and the different locations in the acoustic cavity.

13. The method of claim 12 wherein the acoustic cavity comprises an ear canal.

14. The method of claim 12 wherein combining the plurality of electrical signals comprises summing the plurality of electrical signals.

15. The method of claim 14 further comprising applying a weight to at least one of the electrical signals prior to summing the plurality of electrical signals.

16. The method of claim 12 wherein the speaker input signal further comprises an audio signal.

17. The method of claim 14 wherein the electrical signals are current signals and wherein the summing of the plurality of electrical signals comprises summing the current signals.

18. The method of claim 14 wherein the electrical signals are voltage signals and wherein the summing of the plurality of electrical signals comprises summing the voltage signals.

19. The method of claim 18 wherein each voltage signal comprises a voltage across a resistive load in a serial configuration of a plurality of resistive loads.

20. The method of claim 14 wherein the plurality of electrical signals are digital signals and wherein the summing of the plurality of electrical signals comprises a digital addition of the digital signals.

* * * * *